US006650914B2

(12) United States Patent
Aiga et al.

(10) Patent No.: US 6,650,914 B2
(45) Date of Patent: Nov. 18, 2003

(54) HIGH FREQUENCY SUPER CONDUCTIVE FILTER

(75) Inventors: Fumihiko Aiga, Kanagawa-ken (JP); Hiroyuki Fuke, Kanagawa-ken (JP); Yoshiaki Terashima, Kanagawa-ken (JP); Mutsuki Yamazaki, Kanagawa-ken (JP); Hiroyuki Kayano, Kanagawa-ken (JP); Tatsunori Hashimoto, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 49 days.

(21) Appl. No.: 10/021,244

(22) Filed: Dec. 19, 2001

(65) Prior Publication Data

US 2003/0011440 A1 Jan. 16, 2003

(30) Foreign Application Priority Data

Jul. 13, 2001 (JP) ..... 2001-213280

(51) Int. Cl.[7] ..... H01P 1/203

(52) U.S. Cl. ..... 505/210; 333/204; 333/995; 333/219

(58) Field of Search ..... 333/99.5, 204, 333/219; 505/210, 700, 701, 866

(56) References Cited

U.S. PATENT DOCUMENTS 5,661,112 A * 8/1997 Hatta et al. ..... 505/232
6,122,533 A * 9/2000 Zhang et al. ..... 505/210

* cited by examiner

*Primary Examiner*—Benny T. Lee
*Assistant Examiner*—Kimberly E Glenn
(74) *Attorney, Agent, or Firm*—Oblon, Spivak, McClelland, Maier & Neustadt, P.C.

(57) ABSTRACT

A high frequency filter having steep skirt characteristics using a sapphire R-plane substrate. The filter comprises a substrate having first and second faces. The first face is a sapphire R-plane. A grounded conductive layer is formed on the second face of the substrate. A pair of input/output terminals is formed on the first face. In embodiments, hairpin-shaped resonating portions are formed between the pair of input/output terminals. Each of the resonating portions has at least one long side. Each long side of the resonating portions makes an angle of ψ with <11-20> direction of a sapphire substrate. The angle ψ satisfies relations $0° \leqq \psi \leqq 30°$. In embodiments, the resonating portions are asymetric, J-shaped, or rectangular with an opening.

24 Claims, 36 Drawing Sheets

(a)

(b)

HIGH FREQUENCY SUPER CONDUCTIVE FILTER

CROSS-REFERENCE TO RELATED APPLICATIONS

This application is based upon and claims the benefit of priority from the prior Japanese Patent Applications No. P2001-213280, filed on Jul. 13, 2001; the entire contents of which are incorporated herein by reference.

BACKGROUND OF THE INVENTION

1. Field of the Invention

The present invention relates to high frequency communications equipment. Particularly, the present invention relates to a high frequency filter for passing only a desired signal frequency band.

2. Discussion of the Background

Communications equipment for sending and receiving information wirelessly or by wire is made up of various high frequency devices such as amplifiers, mixers, and filters. Many high frequency devices utilize their resonance characteristics. For example, a bandpass filter includes an array of resonators and has a function of passing signals only in a certain frequency band.

Bandpass filters in communications systems are required to have skirt characteristics such that interference is eliminated between adjacent frequency bands. Skirt characteristics relate to the degree of attenuation over a range of frequencies from an end of a pass frequency band to a stop frequency band. In particular, when a bandpass filter having steep skirt characteristics is used, frequency signals outside the pass frequency band can be strictly eliminated. Accordingly, the frequency band can be divided into plural sections and effectively utilized.

A first requirement for realizing a filter having steep skirt characteristics is that a resonator forming the filter accomplishes a high unloaded Q value. For this purpose, a substrate forming the filter needs to have a small dielectric loss.

Furthermore, if a superconductor is used as the conductor forming the resonator, the conductor loss is quite small. As a result, a quite high unloaded Q value can be accomplished.

Conventionally, $LaAlO_3$ and MgO have been chiefly used as substrates employed for filters. These substrates have dielectric constants of about $10^{-6}$, which are relatively small values.

However, an $LaAlO_3$ substrate is disadvantageous because the dielectric constant across the substrate is not uniform due to the crystal having a twin boundary. Further, MgO is disadvantageous because of its deliquescence and vulnerability to moisture and water.

Alternatively, sapphire substrates may be used as substrates employed for filters. A sapphire ($Al_2O_3$) substrate has a relatively small dielectric loss of $10^{-7}$ to $10^{-8}$. Also, the crystal structure of a sapphire substrate is stable, and the dielectric constant across the substrate is stable. A sapphire substrate also has a stronger mechanical strength than a MgO substrate and is easier to handle. Additionally, it has the advantage of being much cheaper than $LaAlO_3$ and MgO substrates. Sapphire substrates are also higher in thermal conductivity than $LaAlO_3$ and MgO substrates. Accordingly, when a superconductor is used as a conductor and cooling is necessary, the temperature distribution is small and sapphire substrates are advantageous for more stable operation. Accordingly, the sapphire substrate has good characteristics as a substrate for a filter. Sapphire substrates include substrates obtained by cutting out (1-100)-plane (M-plane 11) shown in FIG. 1A and substrates obtained by cutting out (1-102)-plane (R-plane 12) shown in FIG. 1B.

However, a sapphire crystal has a hexagonal system and its dielectric constant is anisotropic. Accordingly, the designing of a circuit utilizing a sapphire substrate is problematic due to the difficulty to design a circuit. Further, a sapphire substrate is problematic when a superconductor is used as a semiconductor, as it is difficult to form good-quality, high-temperature semiconductive film on the M-plane 11.

R-plane substrates have the advantage of being cheaper than M-plane substrates and that good-quality high-temperature superconductive films can be formed on R-plane substrates. However, R-plane substrates are problematic as they increase the size of a device. Further, R-plane substrates are relatively costly, especially when a superconductor is used as a conductor. The increase in size of the device is attributed to forward-coupled filters, filters using meander open-loop resonators, and quasi-lumped element filters that must have many resonators to realize steep skirt characteristics.

SUMMARY OF THE INVENTION

Accordingly, there is a demand for a hairpin type filter formed on a sapphire R-plane or an improved filter that is based on a hairpin type filter. Generally, non-diagonal elements of dielectric constant tensor always contribute on a sapphire R-plane. Therefore, the effects of impedance mismatching differ greatly depending on the geometry of the resonator and on the direction of installation of the resonator. Accordingly, where a sapphire R-plane is used, appropriate geometry and installation direction of the resonator are not previously known. Hence, a small-sized filter has not been previously accomplished.

Embodiments of the present invention provide a high frequency filter. The filter comprises a substrate, a conductive layer, a pair of input terminals, an output terminal, and resonating portions. The substrate has a first face and a second face. The first face is a sapphire R-plane. The conductive layer is on the second face of the substrate and is connected to a ground level. The pair of input terminals and the output terminal are formed on the first face of the substrate. The resonating portions are formed between the pair of the input terminals and the output terminal. The resonating portion has a hairpin-shape and a longer side. The longer side makes an angle of $\psi$ with <11-20> direction of the first face. Angle $\psi$ is $\geqq 0°$ and $\leqq 30°$.

Embodiments of the present invention relate to a high frequency filter comprising a substrate, conductive layer, a pair of input terminals, output terminal, and resonating portions. Resonating portions are formed between the pair of input terminals and the output terminal and have an asymmetric shape.

Embodiments of the present invention alleviate the disadvantages, which are discussed above, of the background art. Accordingly, the embodiments of the present invention comprise a substrate having a relatively uniform dielectric constant across a substrate. The present invention is relatively resilient to moisture and water. Further, the size of the device comprising the embodiments of the present invention is relatively small and can be manufactured in a cost effective manner.

BRIEF DESCRIPTION OF THE DRAWINGS

FIG. 1 is a view illustrating in-plane orientations of a sapphire crystal, and in which FIG. 1A shows the M-plane of the sapphire crystal and FIG. 1B shows the R-plane of the sapphire crystal;

DETAILED DESCRIPTION OF THE EMBODIMENTS

Embodiments of the present invention are hereinafter described in detail.

Figure 1:
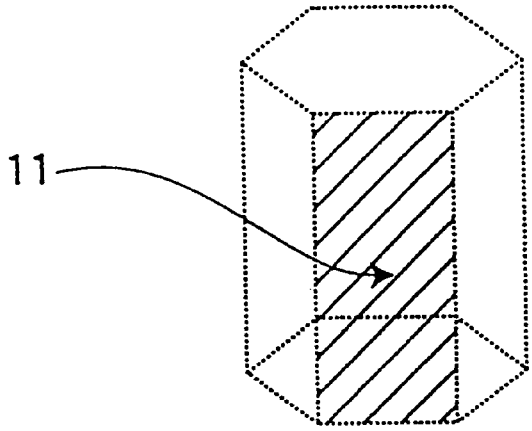
Figure 1:
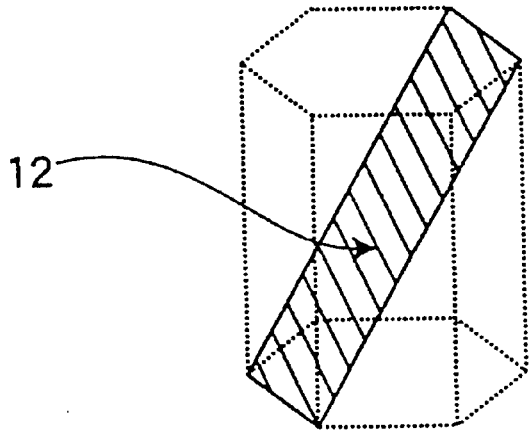

A high frequency filter in accordance with the present invention is formed on a sapphire R-plane 12, which is (1-102)-plane (see FIG. 1B) of a sapphire hexagonal system. A sapphire R-plane substrate has a face on which a sapphire R-plane 12 is exposed. This substrate may be a substrate of sapphire alone or a composite having an exposed sapphire layer. Of course, the actually used substrate is not strictly limited to a substrate with an exposed R-plane. Vicinities to the R-plane 12 can also be used. In particular, angular errors of in-plane orientations may be contained at an accuracy accomplished by ordinary industrial substrate machining.

Figure 2:
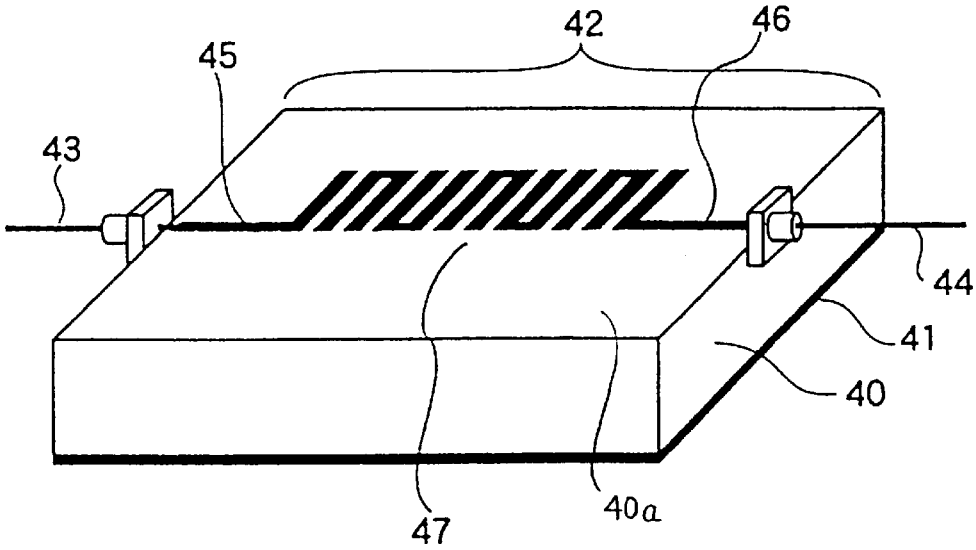
FIG. 2 shows an example illustrating the configuration of a high frequency filter in accordance with the present invention.

An example of the fundamental structure of a high frequency filter in accordance with the present invention is described first. As shown in FIG. 2, a conductor 41 is formed on one face of a substrate 40 having a cut and exposed sapphire R-plane. A resonating circuit 42 is formed on the other face 40a. Conductor 41 is fixed to an electrical potential level. In exemplary embodiments of the present invention, the electrical potential level is a ground potential.

The resonating circuit 42 consists of a patterned conductor on the substrate 40. The resonating circuit 42 is made up of input/output portions 45, 46 and resonating portions 47. The length of the resonating portions 47 corresponds to half of the desired passband wavelength of the filter. The length of the resonating portions 47 is the length of the patterned conductor on one resonating portion 47. The shape of this resonating circuit 42 is described in detail below.

Coaxial lines 43 and 44 are connected with the opposite ends of the resonating circuit 42. Signals are supplied from the coaxial line 43. Signals are output from the coaxial line 44. A coaxial-microstrip transformation is performed between the resonator 42 and each of the coaxial lines 43 and 44.

Figure 3:
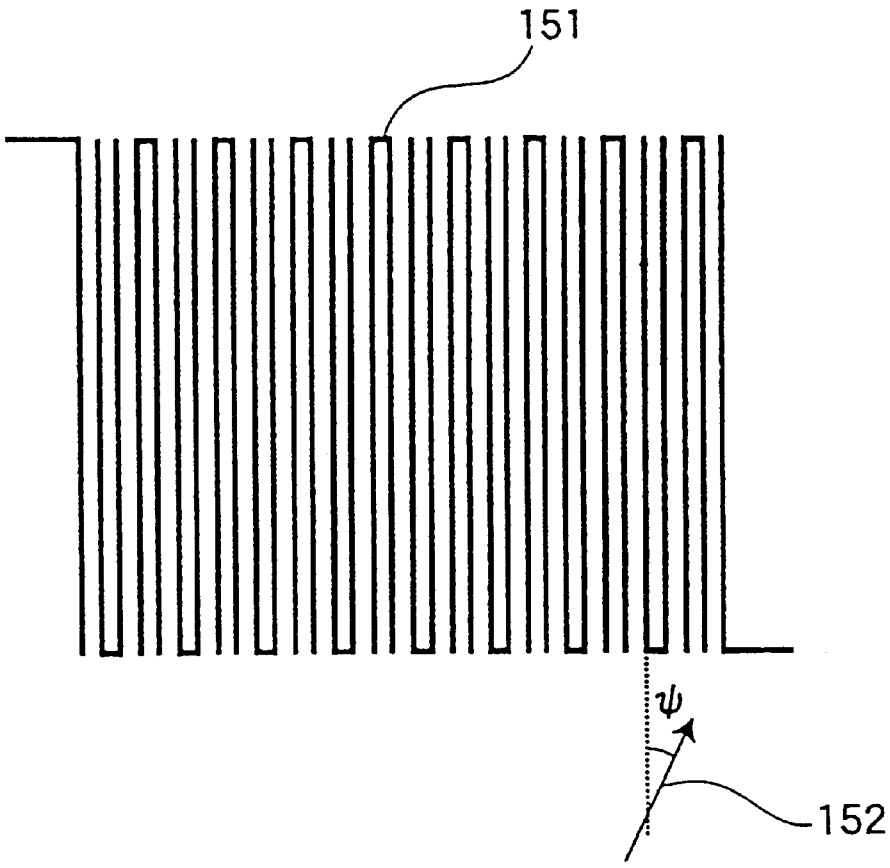
FIG. 3 is a layout diagram of a high frequency filter in accordance with embodiments of the invention.

FIG. 3 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 3 is formed on the other face.

A Y-based superconductive thin film having a thickness of about 500 nm is used in the strip conductor. The linewidth of the strip conductor is about 0.4 mm. Laser evaporation method, sputtering method, co-evaporation method, or other method can be used to grow a superconductor film. Also, to obtain a good-quality superconductive thin film, a buffer layer can be formed between the substrate and the superconductive thin film. The buffer layer is made of $CeO_2$ or YSZ, for example. Although the Y-based superconductor thin film is used in the embodiments of the present invention, the other materials having low surface resistances can be used. The thin film has a lower surface resistance than about $10^{-2}$ Ohms. It is better that the thin film has a lower surface resistance than about $10^{-4}$ Ohms.

In the present embodiment, plural resonating portions 151 are positioned between L-shaped input and output portions as shown in FIG. 3. Each resonating portion 151 has a shape of a symmetrical hairpin. The hairpin has two longer sides and a connector portion interconnecting them. In this example, the hairpin shape has corners. A hairpin shape having no corners can also be used. In the present specification, the hairpin type embraces both shape having corners and shape having no corners.

The resonating portions 151 are so positioned that the angle ψ made between each longer side of the resonating portions 151 and <11-20> direction 152 on the sapphire substrate satisfies $0° \leqq \psi \leqq 30°$. Each longer side of the resonating portions 151 may agree with the <11-20> direction 152. The orientation <11-20> is a vector having the direction of the arrow 152 in the figure. Since the longer sides have no direction, the angle ψ made between the orientation <11-20> and each longer side is defined to be 0° to 90°. Since the dielectric constant of sapphire has anisotropy, where a hairpin resonator is placed on an R-plane, impedance mismatching will disturb ripples within the passband of the filter greatly unless the orientation of the arrangement of the hairpin resonator is appropriately selected.

The inventors fabricated a 17-pole hairpin filter on a sapphire R-plane and made experiments. The 17-pole filter is a filter including 17 resonating portions 151. In the experiments, the angle ψ made between each longer side of the hairpin resonating portions 151 and the <11-20> direction of sapphire was varied from 0° to 90°.

Figure 4:
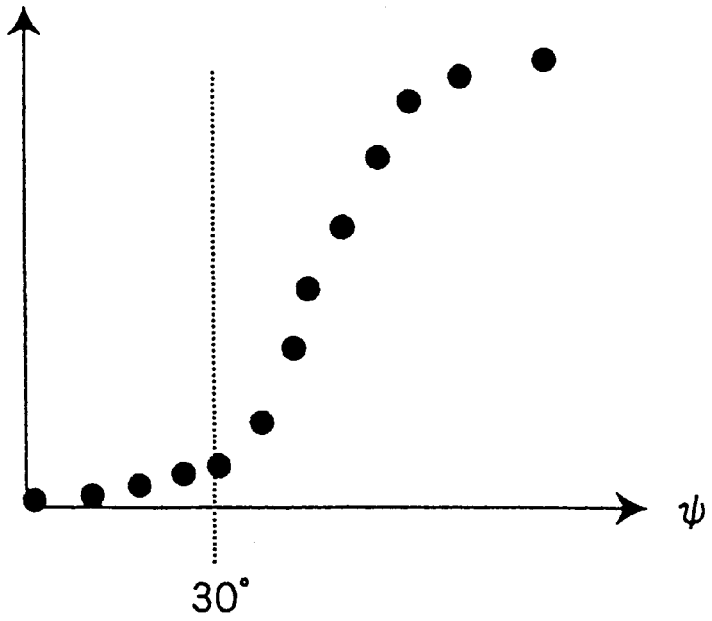
FIG. 4 is a diagram illustrating variations in the amount of ripple when the angle ψ made between <11-20> direction on a sapphire R-plane and the direction of the longer sides of each resonating portion is varied from 0° to 90°.

The results of the experiments are shown in FIG. 4, where the horizontal axis indicates ψ, while the vertical axis indicates the amount of ripple within the passband. The dotted line indicates 104 =30°. That is, it has been empirically found that the disturbance of in-band ripple is only less than 30 dB where $0° \leqq \psi \leqq 30°$. On the other hand, where ψ is in excess of 30°, ripple disturbance increases rapidly. Therefore, if $0° \leqq \psi \leqq 30°$ is set, desired filter characteristics can be accomplished without disturbing ripple in the passband. Note that where ψis 0°, the disturbance is minimal with desirable results.

As the number of poles (the number of resonating portions of the filter) is increased, ripple disturbance due to impedance mismatching increases. Therefore, as the number of poles is increased, ψ is preferably set closer to 0°.

Figure 5:
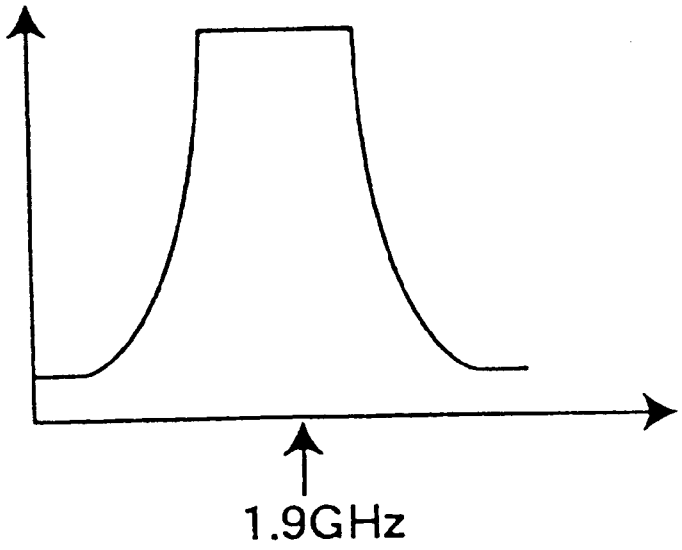
FIG. 5 is a frequency characteristic diagram of the high frequency filter in accordance with embodiments of the invention.

An example in which resonating portions of this shape are used and the angle made between the direction of each longer side and the <11-20> direction of sapphire substrate is set to about 10° is next described. FIG. 5 shows the transmission characteristics of this filter circuit. The horizontal axis indicates the input signal frequency, while the vertical axis indicates relative output signal intensity.

Where the center frequency was about 1.9 GHz and the bandwidth was about 20 MHZ, the obtained characteristics were ripple of about 0.5 dB and insertion loss of about 0.4 dB. The bandwidth referred to herein is the width of a frequency band in which output intensities smaller than the maximum value of the output signal by less than 3 dB are obtained. The ripple indicates the difference between the maximum and minimum values of the amount of passage in the pass frequency band. The insertion loss is the signal intensity loss caused by insertion of a filter. Also, excellent skirt characteristics of about 30 dB/1 MHZ were obtained. In such symmetrical hairpin type resonating portions, desired filter characteristics can be accomplished without disturbing the ripple in the passband by controlling the angle made between each longer side of the resonating portions and the <11-20> direction of the sapphire substrate.

Figure 6:
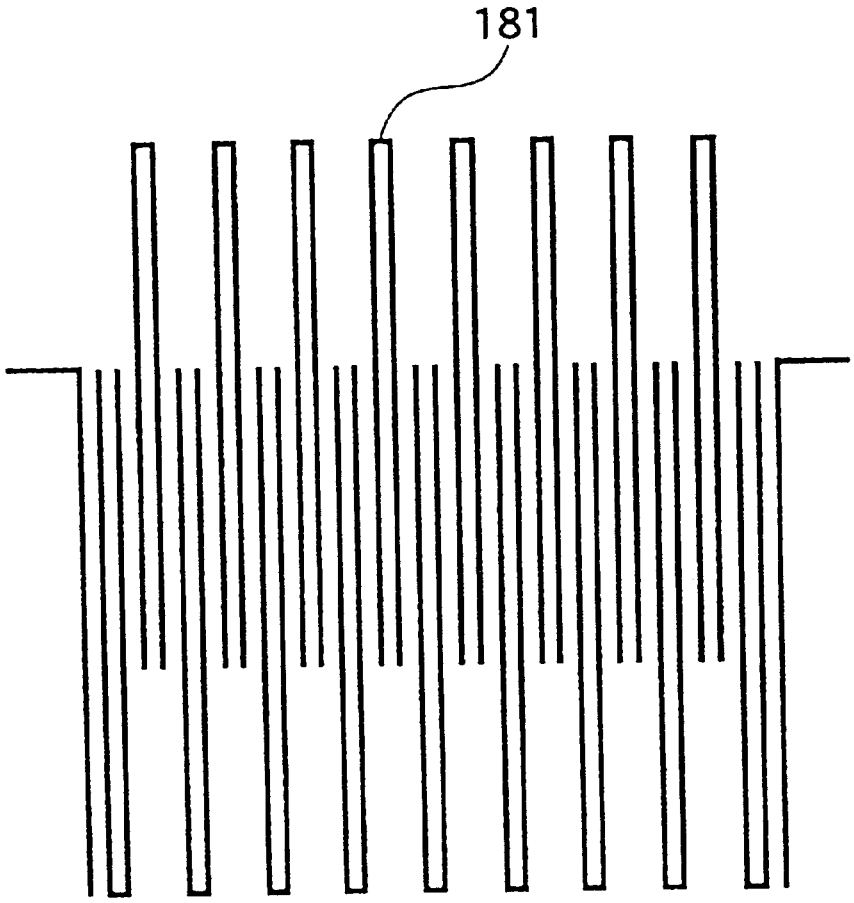
FIG. 6 is a layout diagram of a high frequency filter in accordance with embodiments of the invention.

FIG. 6 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 6 is formed on the other face. A Y-based superconductive thin film having a thickness of about 500 nm is used in this strip conductor. The linewidth of the strip conductor is about 0.4 mm.

In embodiments of the present application, plural resonating portions 181 are positioned between L-shaped input and output portions as shown in FIG. 6. Each resonating portion 181 is a hairpin type having corners. In embodiments, the longer sides of the hairpin are aligned and each resonating portion 181 is arranged with an offset. The offset arrangement of the resonators weakens the coupling between the resonators, thus accomplishing a small-sized, 17-pole filter. Also in this example, the resonating portions 181 are so positioned that the angle ψ made between each longer side of the resonating portions 181 and <11-20> direction 152 on the sapphire substrate satisfies $0° \leqq \psi \leqq 30°$.

Figure 7:
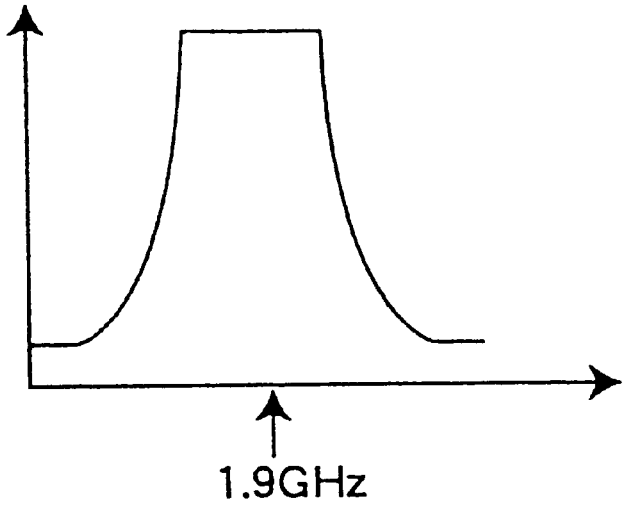
FIG. 7 is a frequency characteristic diagram of the high frequency filter in accordance with embodiments of the invention.

The transmission characteristics of this filter circuit are shown in FIG. 7. The center frequency was about 1.9 GHz and the bandwidth was about 20 MHZ, the obtained characteristics were ripple of about 0.4 dB and insertion loss of about 0.5 dB. Also, excellent skirt characteristics of about 30 dB/1 MHZ were obtained. This arrangement of hairpin type resonating portions can accomplish desired filter characteristics without disturbing the ripple in the passband by controlling the angle made between each longer side of the resonating portions and the <11-20> direction of the sapphire substrate.

Figure 8:
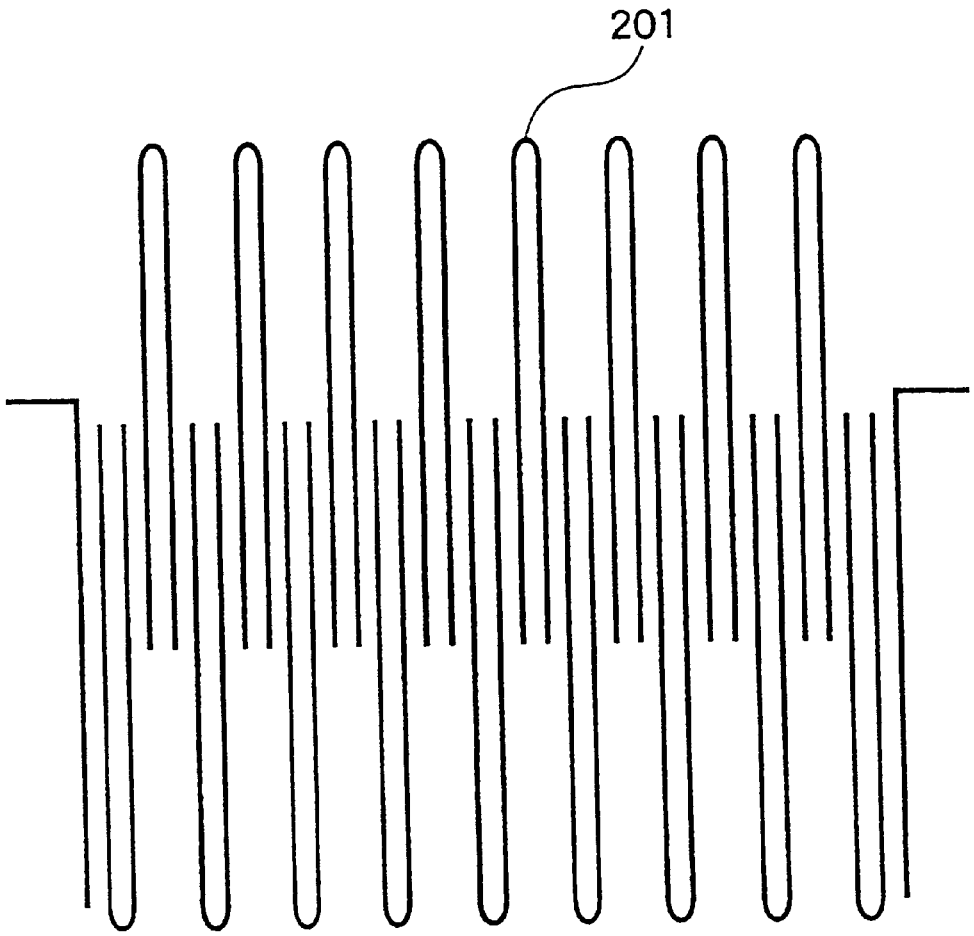
FIG. 8 is a layout diagram of a high frequency filter in accordance with embodiments of the invention.

FIG. 8 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 8 is formed on the other face. A Y-based superconductive thin film having a thickness of about 500 nm is used in the strip conductor. The linewidth of the strip conductor is about 0.4 mm.

In embodiments of the present invention, resonating portions 201 are positioned between L-shaped input and output portions as shown in FIG. 8. Each resonating portion 201 is a hairpin type having no corners.

In embodiments of the present invention, the resonating portions 201 are so positioned that the angle ψ made between each longer side of the resonating portions 201 and <11-20> direction 152 on the sapphire substrate satisfies $0° \leqq \psi \leqq 30°$.

Figure 9:
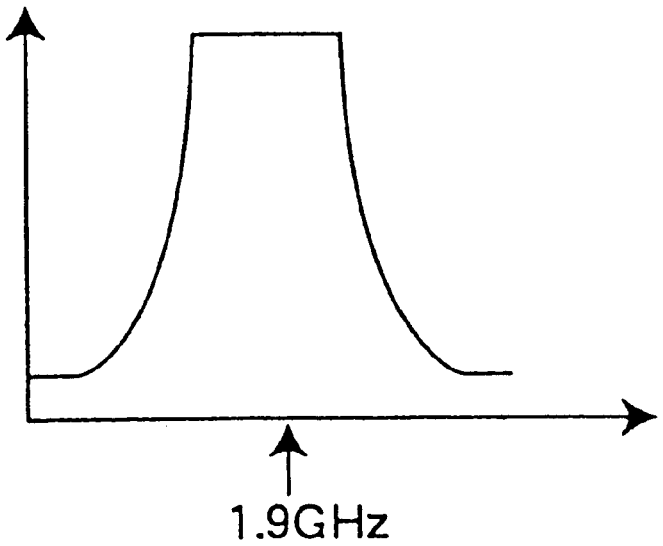
FIG. 9 is a frequency characteristic diagram of the high frequency filter in accordance with embodiments of the invention.

The transmission characteristics of this filter circuit are shown in FIG. 9. The center frequency was about 1.9 GHz and the bandwidth was about 20 MHZ, the obtained characteristics were ripple of about 0.4 dB and insertion loss of about 0.4 dB. Also, excellent skirt characteristics of about 30 dB/1 MHZ were obtained. The impedance mismatching can be mitigated and the insertion loss can be reduced further by shaping the shorter side portions of the hairpin type resonators into arc-shaped forms.

Figure 10:
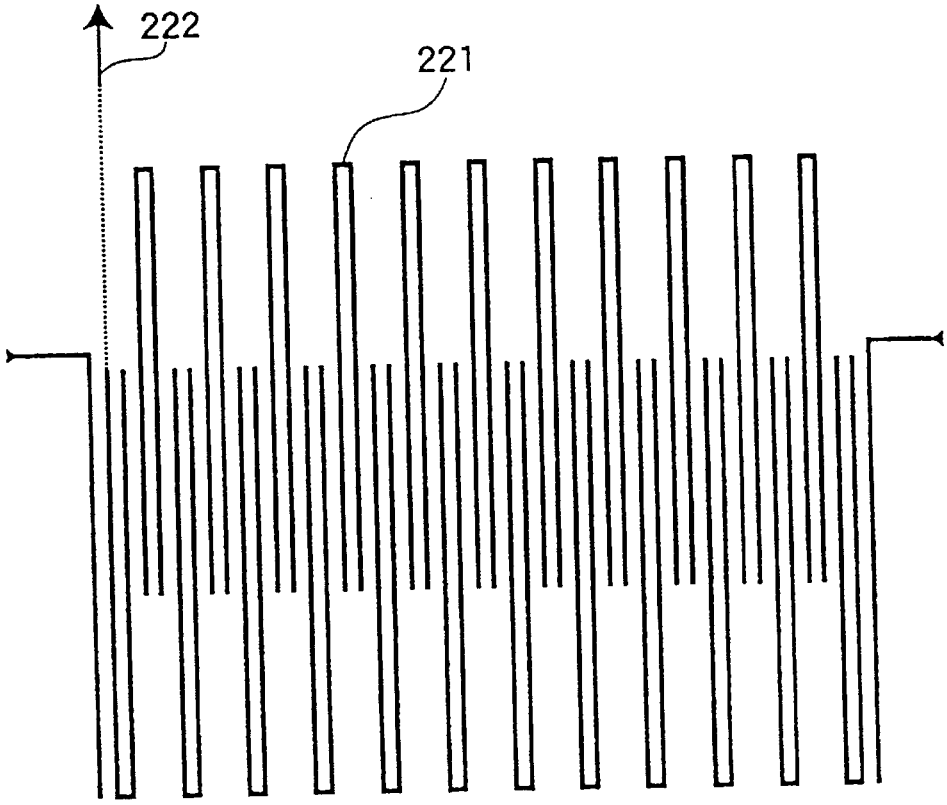
FIG. 10 is a layout diagram of a high frequency filter in accordance with embodiments of the invention.

FIG. 10 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 10 is formed on the other face. A Y-based superconductive thin film having a thickness of about 500 nm is used in the strip conductor. The linewidth of the strip conductor is about 0.4 mm.

In embodiments of the present invention, resonating portions 221 are positioned between L-shaped input and output portions as shown in FIG. 10. Each resonating portion 221 is a hairpin type having corners. An example of a 23-pole filter is described now.

Also, in this example, each longer side of the resonating portions 221 agrees with the <11-20> direction 222 on the sapphire substrate. That is, this is a case in which the angle ψ made between the <11-20> direction and each longer side of the resonating portions is 0°.

Figure 11:
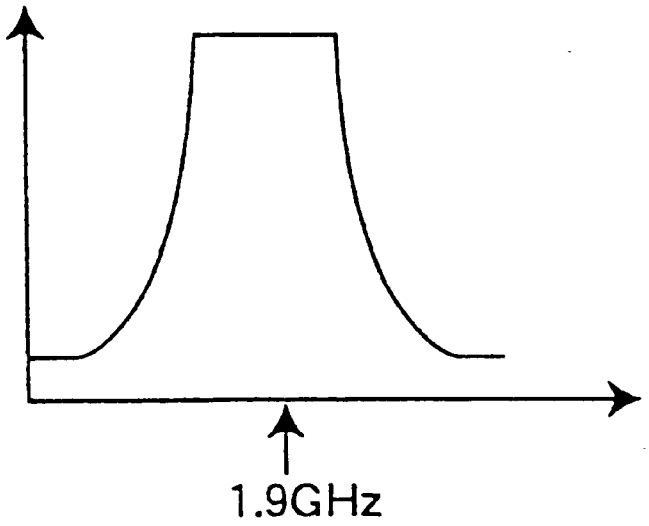
FIG. 11 is a frequency characteristic diagram of the high frequency filter in accordance with embodiments of the invention.

The transmission characteristics of this filter circuit are shown in FIG. 11. The center frequency was about 1.9 GHz and the bandwidth was about 20 MHZ, the obtained characteristics were ripple of about 0.4 dB and insertion loss of about 0.5 dB. Also, excellent skirt characteristics of about 40 dB /1 MHZ were obtained.

This arrangement of hairpin type resonators can also accomplish desired filter characteristics without disturbing the ripple in the passband by controlling the angle made between each longer side and the <11-20> direction of the sapphire substrate.

Figure 12:
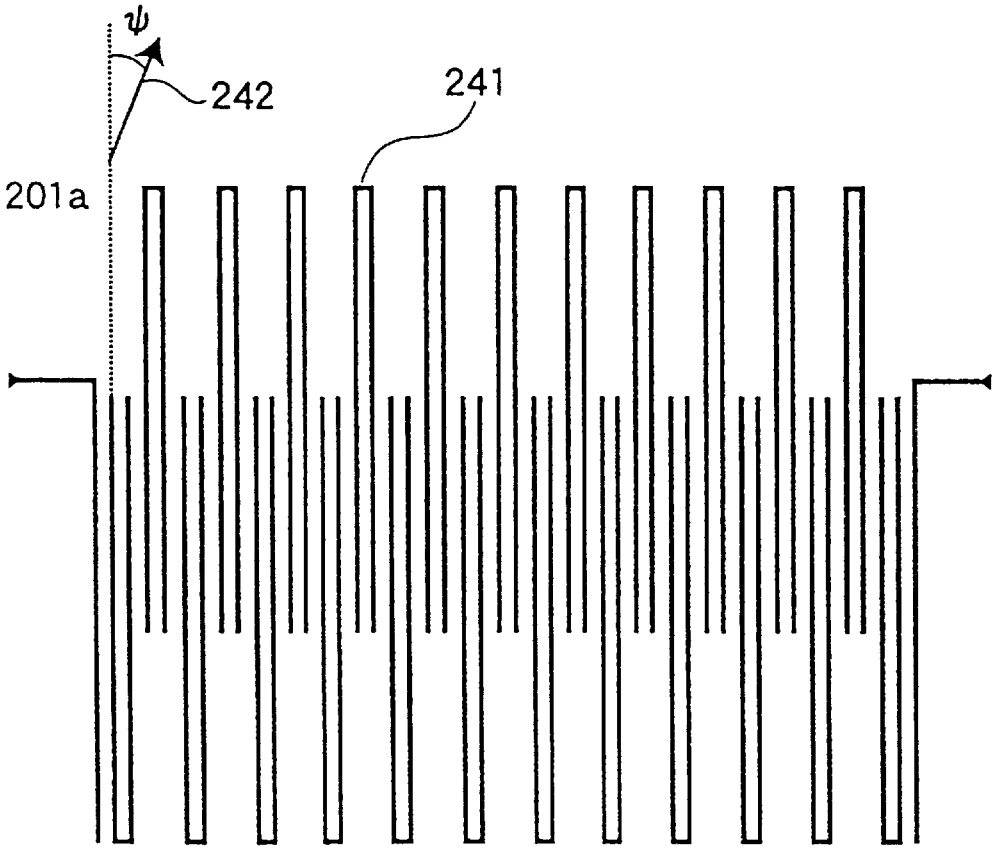
FIG. 12 is a layout diagram of a high frequency filter in accordance with embodiments of the invention.

FIG. 12 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 12 is formed on the other face. A Y-based superconductive thin film having a thickness of about 500 nm is used in the strip conductor. The linewidth of the strip conductor is about 0.4 mm.

In embodiments of the present invention, resonating portions 241 are positioned between L-shaped input and output portions as shown in FIG. 12. Each resonating portion 241 is a hairpin type having corners. This is a case in which the angle ψ made between each longer side of the resonating portions 241 and the <11-20> direction 242 on the sapphire substrate is about 10°.

Figure 13:
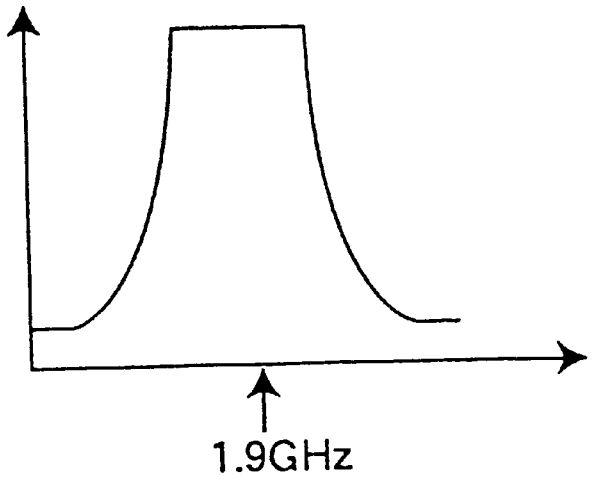
FIG. 13 is a frequency characteristic diagram of the high frequency filter in accordance with embodiments of the invention.

The transmission characteristics of this filter circuit are shown in FIG. 13. The center frequency was about 1.9 GHz and the bandwidth was about 20 MHZ, the obtained characteristics were ripple of about 0.5 dB and insertion loss of about 0.5 dB. This arrangement of hairpin type resonating portions can also accomplish desired filter characteristics without disturbing the ripple in the passband by controlling the angle made between each longer side and the <11-20> direction of the sapphire substrate.

Figure 14:
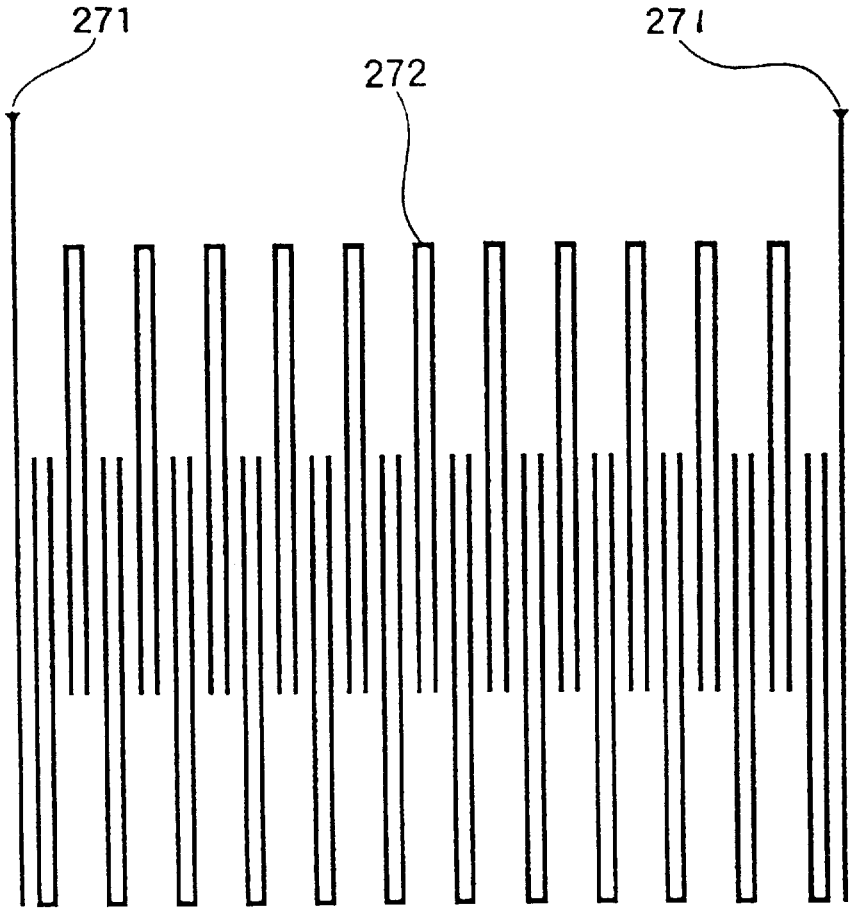
FIG. 14 is a layout diagram of a high frequency filter in accordance with embodiments of the invention.

FIG. 14 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 14 is formed on the other face. A Y-based superconductive thin film having a thickness of about 500 nm is used in the strip conductor. The linewidth of the strip conductor is about 0.4 mm.

In embodiments of the present invention, the input and output portions are not bent into an L-shaped form. Rather, straight input and output portions 271 as shown in FIG. 14 are provided. Each resonating portion 272 is a hairpin type having corners. The angle ψ made between each longer side of the resonating portions 272 and the <11-20> direction on the sapphire substrate is 0°, in the same way as in the fourth embodiment.

Figure 15:
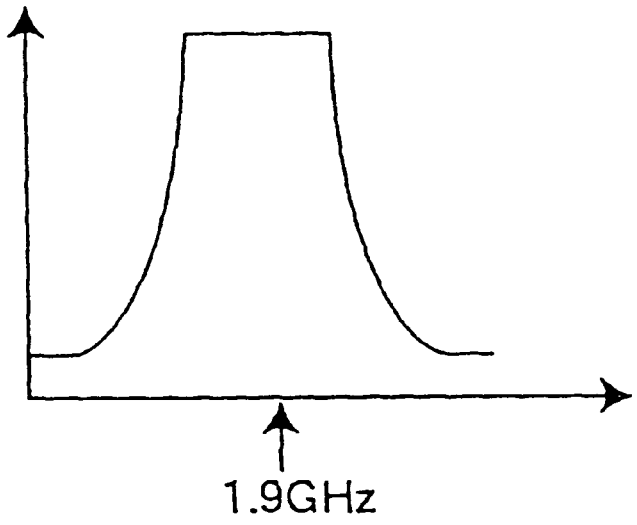
FIG. 15 is a frequency characteristic diagram of the high frequency filter in accordance with embodiments of the invention.

The transmission characteristics of this filter circuit are shown in FIG. 15. The center frequency was about 1.9 GHz and the bandwidth was about 20 MHZ, the obtained characteristics were ripple of about 0.4 dB and insertion loss of about 0.5 dB. Also, excellent skirt characteristics of about 40 dB /1 MHZ were obtained. the input and output portions may assume linear forms or draw arbitrary curves such as arcs.

Figure 16:
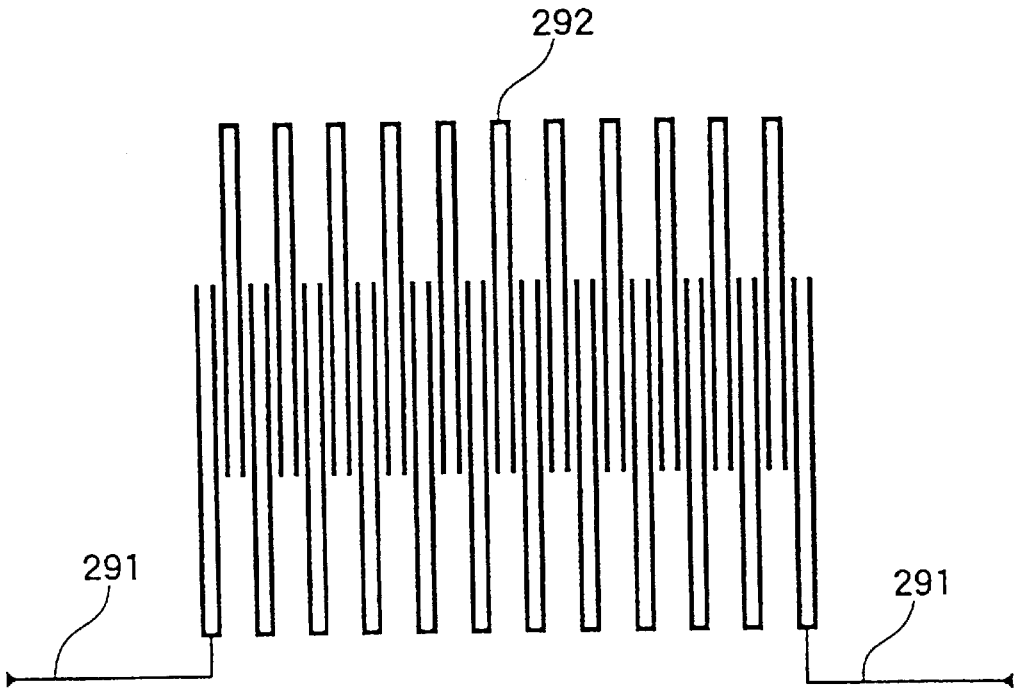
FIG. 16 is a layout diagram of a high frequency filter in accordance with embodiments of the invention.

FIG. 16 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 16 is formed on the other face. A Y-based superconductive thin film having a thickness of about 500 nm is used in the strip conductor. The linewidth of the strip conductor is about 0.4 mm.

In embodiments of the present invention, there are provided input and output portions 291 utilizing tap excitation as shown in FIG. 16 instead of gap excitation. Each resonating portion 292 is a hairpin type having corners. The angle ψ made between each longer side of the resonating portions 292 and the <11-20> direction on the sapphire substrate is 0°.

Figure 17:
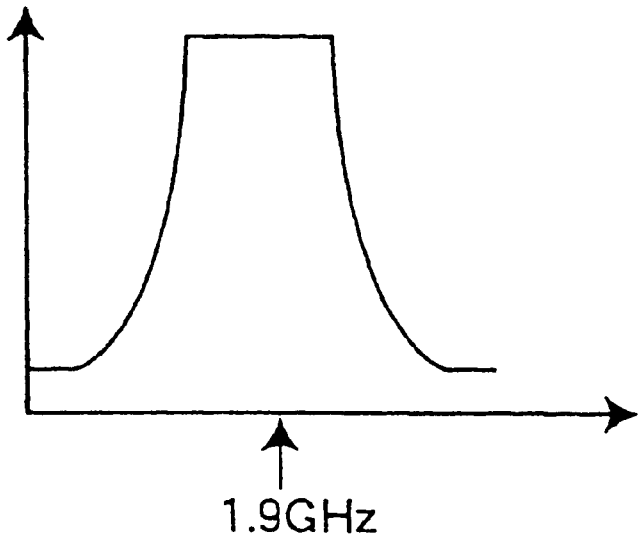
FIG. 17 is a frequency characteristic diagram of the high frequency filter in accordance with embodiments of the invention.

The transmission characteristics of this filter circuit are shown in FIG. 17. The center frequency was about 1.9 GHz and the bandwidth was about 20 MHZ. The obtained characteristics were ripple of about 0.4 dB and insertion loss of about 0.5 dB. Also, excellent skirt characteristics of about 40 dB /1 MHZ were obtained. The input and output portions may make use of tap excitation. Also, 291 does not need to take an L-shaped form but may draw straight lines or arbitrary curves such as arcs.

Figure 18:
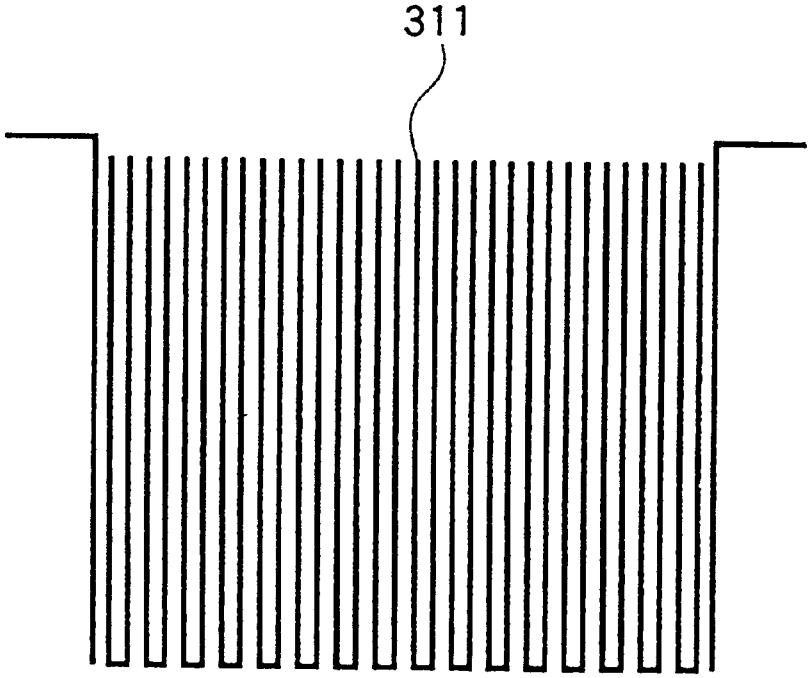
FIG. 18 is a layout diagram of a high frequency filter in accordance with embodiments of the invention.

FIG. 18 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 18 is formed on the other face. A Y-based superconductive thin film having a thickness of about 500 nm is used in this strip conductor. The linewidth of the strip conductor is about 0.4 mm.

In embodiments of the present invention, a so-called hairpin comb type filter is built. Each resonating portion 311 is a hairpin type having corners. The angle ψ made between each longer side of the resonating portions 311 and the <11-20> direction on the sapphire substrate is 0°.

Figure 19:
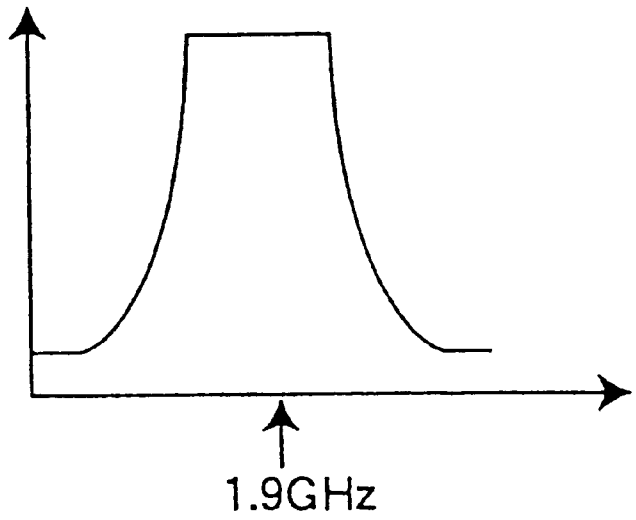
FIG. 19 is a frequency characteristic diagram of the high frequency filter in accordance with embodiments of the invention.

The transmission characteristics of this filter circuit are shown in FIG. 19. The center frequency was about 1.9 GHz and the bandwidth was about 20 MHZ, the obtained characteristics were ripple of about 0.4 dB and insertion loss of about 0.5 dB. Also, excellent skirt characteristics of about 30 dB/1 MHZ were obtained. The hairpin comb type filter can also accomplish desired filter characteristics without disturbing the ripple in the passband by controlling the angle made between each longer side of the hairpin type resonating portions and the <11-20> direction of the sapphire substrate. However, the hairpin comb type filter cannot easily accomplish a wideband filter that needs strong coupling between resonating portions. The hairpin type has the advantage that it is easier to design.

Figure 20:
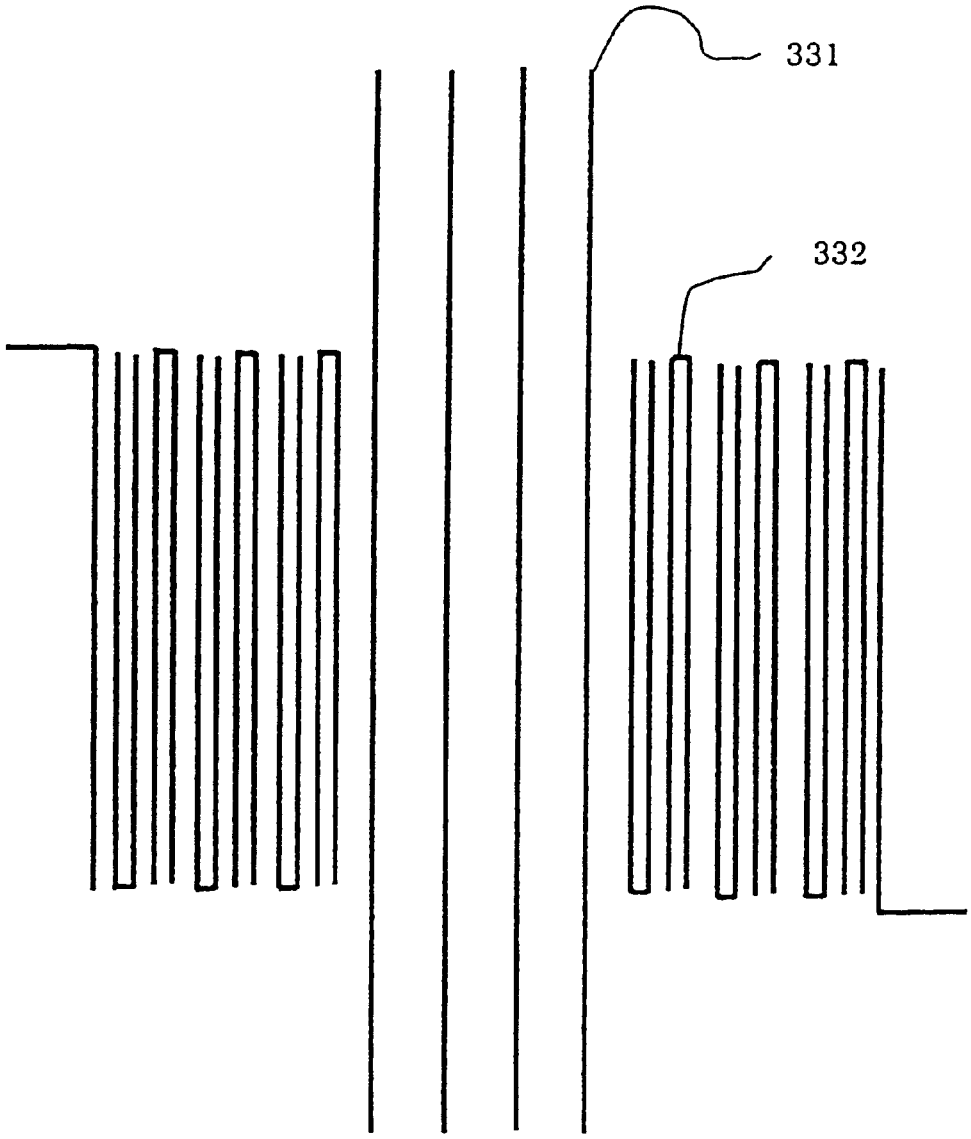
FIG. 20 is a layout diagram of a high frequency filter in accordance with embodiments of the invention.

FIG. 20 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 20 is formed on the other face. A Y-based superconductive thin film having a thickness of about 500 nm is used in this strip conductor. The linewidth of the strip conductor is about 0.4 mm.

In embodiments of the present invention, the high frequency filter is composed of both hairpin type resonating portions 332 having corners and straight type resonating portions 331. The angle ψ made between each longer side of the resonating portions 311 and the <11-20> direction on the sapphire substrate is 0°, in the same way as in the fourth embodiment.

Figure 21:
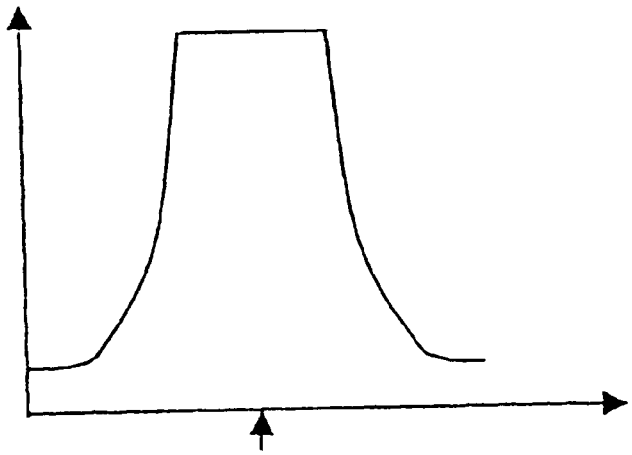
FIG. 21 is a frequency characteristic diagram of the high frequency filter in accordance with embodiments of the invention.

The transmission characteristics of this filter circuit are shown in FIG. 21. The center frequency was about 1.9 GHz and the bandwidth was about 20 MHZ, the obtained characteristics were ripple of about 0.4 dB and insertion loss of about 0.5 dB. Also, excellent skirt characteristics of about 30 dB/1 MHZ were obtained. The filter including both hairpin type resonating portions and resonating portions of other shape can accomplish desired filter characteristics without disturbing the ripple in the passband by controlling the angle made between each longer side of the hairpin type resonating portions and the <11-20> direction of the sapphire substrate.

Figure 22:
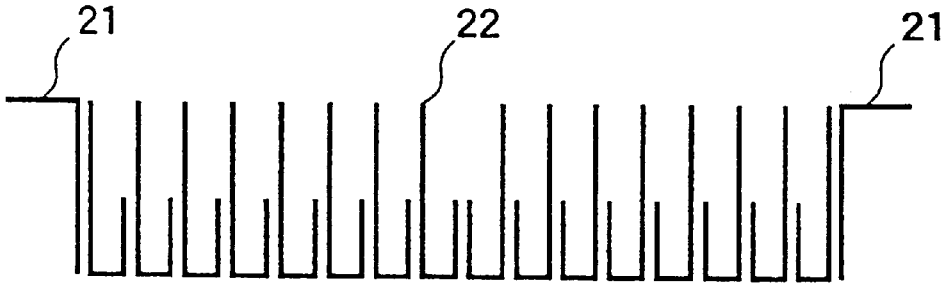
FIG. 22 is a layout diagram of a high frequency filter in accordance with embodiments of the invention.

FIG. 22 shows a layout diagram of resonators of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 22 is formed on the other face. A Y-based superconductive thin film having a thickness of about 500 nm is used in the conductor. The linewidth of the strip conductor is about 0.4 mm.

In embodiments of the present invention, plural resonating portions 22 are disposed between L-shaped input and output portions 21. Each resonating portion 22 comprises a hairpin in which one leg is shorter than the other, and is made up of straight portions and a corner portion. There is no curved portion. In the present specification, such a shape is referred to as an angular J type. A 16-pole filter in which 16 resonating portions 22 are arranged is described now.

The whole filter device is so arranged that it has line symmetry about its center. However, the lengths of the straight portions of the input and output portions 21 and of the resonating portions 22 are so determined that their integral multiples do not agree with half of the passband wavelength of the filter.

Figure 23:
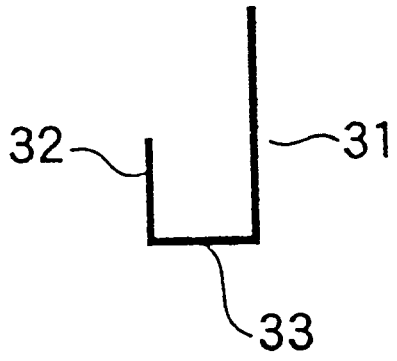
FIG. 23 is an enlarged view of one resonator of the high frequency filter in accordance with embodiments of the invention.

As shown in FIG. 23, each resonating portion 22 is so shaped that a longer side portion 31 and a shorter side portion 32 are connected by a connector portion 33. The longer side portion 31 and the shorter side portion 32 are different in length. The length of the shorter side portion 32 can be zero. In FIG. 23, the longer side portion 31 is located on the side of the input and output portions 21. It also possible that the shorter side portion 31 is located on the side of the input and output portions 21.

In this example, the longer side portion 31 is about 20 mm, the shorter side portion 32 is about 9.5 mm, and the connector portion 33 is about 0.5 mm. Resonators of this shape are positioned on the sapphire R-plane, impedance mismatching occurs whenever the conductor bends because of dielectric anisotropy of sapphire. This impedance mismatching induces resonance or anti-resonance corresponding to the length of the straight portions of the conductor. However, the length of the straight portions of the resonators is so determined that integral multiples of the length do not agree with the wavelength of the desired pass frequency band of the filter. This prevents unwanted resonance and anti-resonance within the pass frequency band of the filter. Therefore, desired filter characteristics can be realized without disturbing ripples within the pass frequency band. If such asymmetrical resonators 22 are used, the resonators can be formed in arbitrary direction on the sapphire R-plane.

Figure 24:
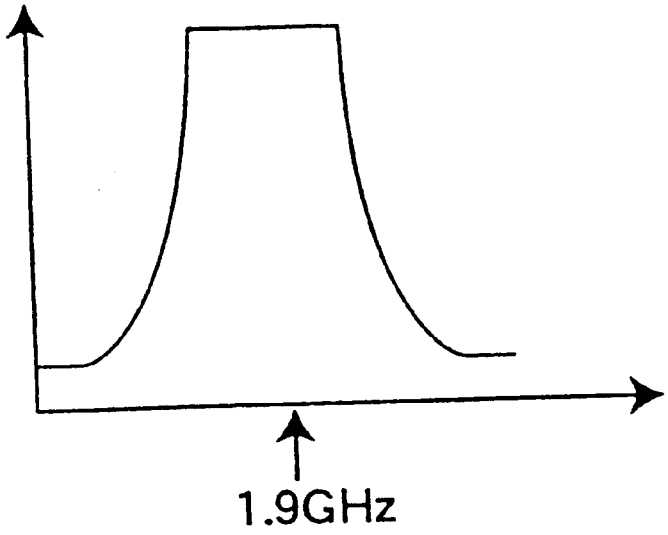
FIG. 24 is a frequency characteristic diagram of the high frequency filter in accordance with embodiments of the invention.

FIG. 24 shows the transmission characteristics of this high frequency filter. A conductor is mounted so as to correspond to a center frequency of about 1.9 GHz and a bandwidth of about 20 MHZ. Measurements were made. Characteristics including ripple of about 0.3 dB and insertion loss of about 0.4 dB were obtained. Also, excellent skirt characteristics of about 30 dB/1 MHZ were obtained.

Figure 25:
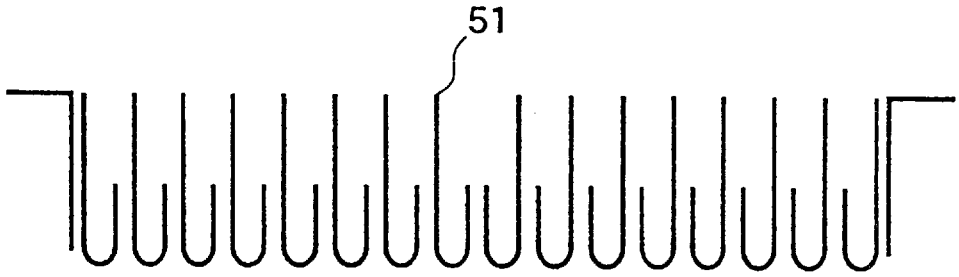
FIG. 25 is a layout diagram of a high frequency filter in accordance with embodiments of the invention.

FIG. 25 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 25 is formed on the other face. A Y-based superconductive thin film having a thickness of about 500 nm is used in this strip conductor. The linewidth of the strip conductor is about 0.4 mm.

In embodiments of the present invention, resonating portions 51 are disposed between L-shaped input and output portions. Each resonating portion 51 has a hairpin in which one leg is shorter than the other. In the present specification, such a shape is referred to as a J type. This is obtained by removing the corners of the resonators used in the tenth embodiment to make curved connector portions. Each connector portion may use an arc. Shorter and longer side portions may be connected smoothly. In FIG. 25, the longer side portion is positioned on the side of the input and output portions. The shorter side portion may be located on the side of the input and output portions. A high frequency filter is similarly constructed except that resonating portions of this shape are used.

Figure 26:
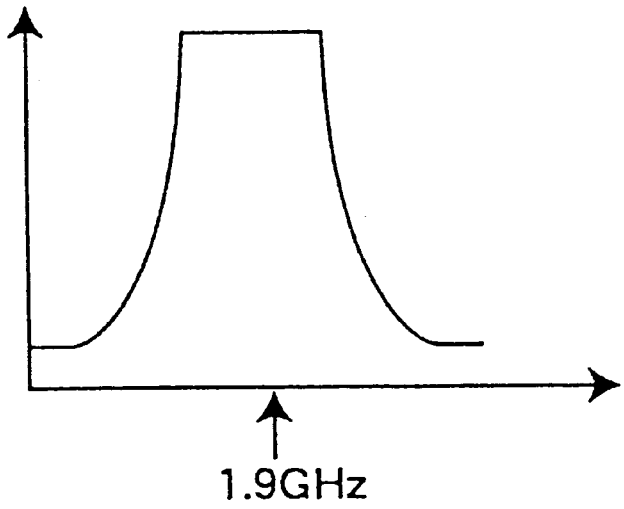
FIG. 26 is a frequency characteristic diagram of the high frequency filter in accordance with embodiments of the invention.

FIG. 26 shows a layout diagram of a high frequency filter in accordance with embodiments of the present invention. The center frequency was about 1.9 GHz and the bandwidth was about 20 MHZ, the obtained characteristics were ripple of about 0.3 dB and insertion loss of about 0.4 dB. Also, excellent skirt characteristics of about 30 dB/1 MHZ were obtained. In such resonating portions, resonance and so on produced in the straight portions are different from the wavelength of the pass frequency band and so desired filter characteristics can be realized without disturbing ripple in the passband. Also, resonators can be formed in any arbitrary direction on the R-plane.

Figure 27:
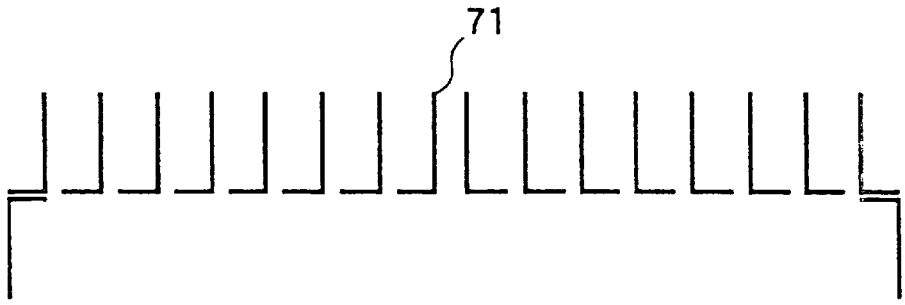
FIG. 27 is a layout diagram of a high frequency filter in accordance with embodiments of the invention.

FIG. 27 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 7 is formed on the other face. A Y-based superconductive thin film having a thickness of about 500 nm is used as this strip conductor. The linewidth of the strip conductor is about 0.4 mm.

In embodiments of the present invention, resonating portions 71 are disposed between L-shaped input and output portions. Each resonating portion 71 takes an L-shaped form. This corresponds to one obtained by setting the length of the shorter side portions of the resonators in the first embodiment to zero. In the present specification, this shape is also referred to as a J type of finite shape. A high frequency filter is similarly constructed except that resonating portions of this shape are used.

Figure 28:
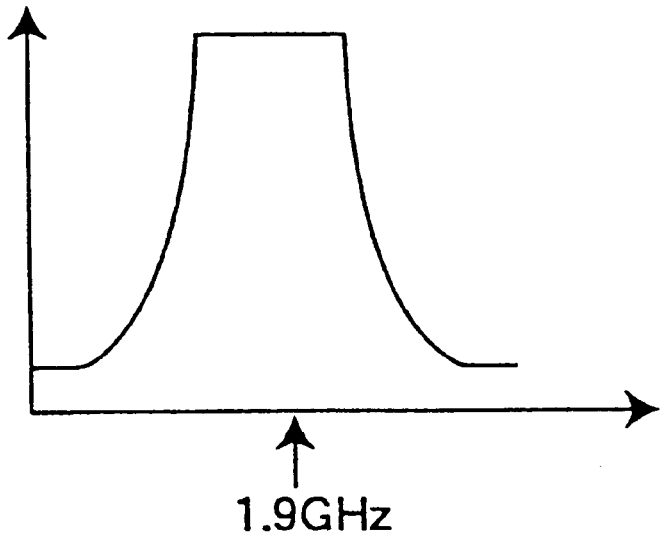
FIG. 28 is a frequency characteristic diagram of the high frequency filter in accordance with embodiments of the invention.

FIG. 28 shows the transmission characteristics of this high frequency filter. The center frequency was about 1.9 GHz and the bandwidth was about 20 MHZ, the obtained characteristics were ripple of about 0.3 dB and insertion loss of about 0.4 dB. Also, excellent skirt characteristics of about 30 dB/1 MHZ were obtained. Also, in such resonators, resonance and so on produced in the straight portions are different from the wavelength of the pass frequency band and so desired filter characteristics can be realized without disturbing ripple in the passband. Also, resonators can be formed in any arbitrary direction on the R-plane.

Figure 29:
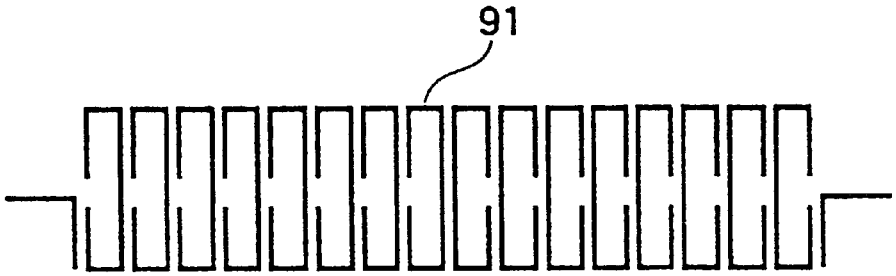
FIG. 29 is a layout diagram of a high frequency filter in accordance with embodiments of the invention.

FIG. 29 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 9 is formed on the other face. A Y-based superconductive thin film having a thickness of about 500 mm is used in this strip conductor. The linewidth of the strip conductor is about 0.4 mm.

In embodiments of the present invention, resonating portions 91 as shown in FIG. 29 are disposed between L-shaped input and output portions. Each resonating portion 91 takes a rectangular form having a cut portion. In the present specification, this shape is referred to as a rectangular shape with cutout.

Figure 30:
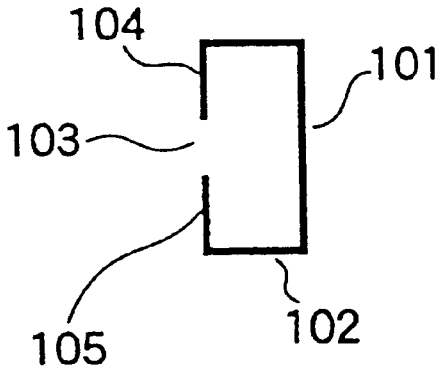
FIG. 30 is an enlarged view of one resonator of the high frequency filter in accordance with embodiments of the invention.

FIG. 30 shows a rectangular shape with cutout. This rectangular shape has a longer side portion 101 and a connector portion 102. A cut portion 103 is formed in another longer side 101. Shorter side portions 104 and 105 are formed on both sides of the cut portion 103. It is not always necessary that the shorter side portions 104 and 105 be identical in length. A high frequency filter is similarly constructed similarly except that resonating portions of this shape are used.

Figure 31:
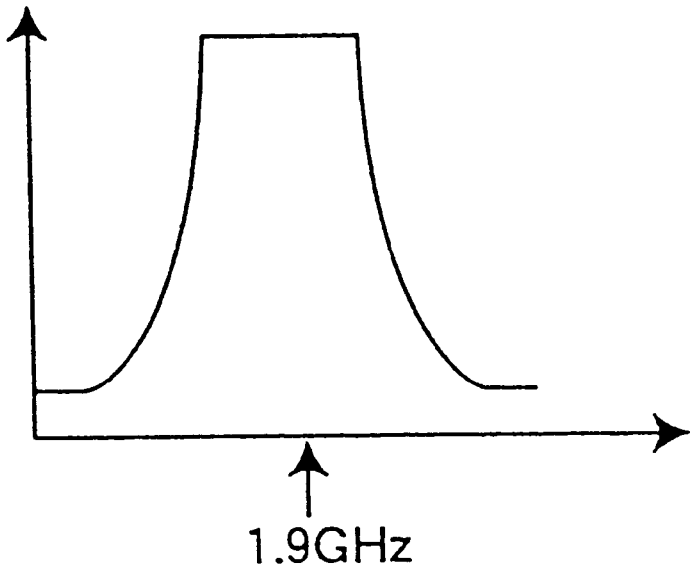
FIG. 31 is a frequency characteristic diagram of the high frequency filter in accordance with embodiments of the invention.

FIG. 31 shows the transmission characteristics of this high frequency filter. The center frequency was about 1.9 GHz and the bandwidth was about 20 MHZ, the obtained characteristics were ripple of about 0.3 dB and insertion loss of about 0.4 dB. Also, excellent skirt characteristics of about 30 dB/1 MHZ were obtained. In such resonating portions, resonance and so on produced in the straight portions are different from the wavelength of the pass frequency band and so desired filter characteristics can be realized without disturbing ripple in the passband. Also, resonators can be formed in any arbitrary direction on the R-plane.

Figure 32:
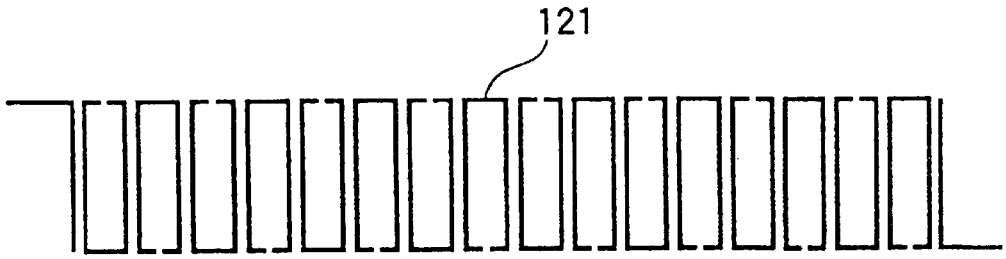
FIG. 32 is a layout diagram of a high frequency filter in accordance with embodiments of the invention.

FIG. 32 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 12 is formed on the other face. A Y-based superconductive thin film having a thickness of about 500 nm is used in this strip conductor. The linewidth of the strip conductor is about 0.4 mm.

In embodiments of the present invention, resonating portions 121 are disposed between L-shaped input and output portions as shown in FIG. 32. Each resonating portion 121 takes a rectangular form having a cut portion. In the thirteenth embodiment, the cut portion is located on the side of the longer side of a rectangle. In embodiments of the present invention, the cut portion is located in the connector portion of the rectangle. In the present specification, this shape is also referred to as a rectangle with cutout. In FIG. 32, such resonating portions 121 are so located that the cutout portions alternate with each other. It is also possible to align the cutout portions in one direction.

Figure 33:
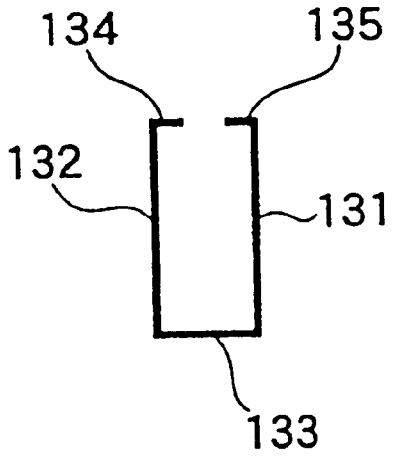
FIG. 33 is an enlarged view of one resonator of the high frequency filter in accordance with embodiments of the invention.

FIG. 33 shows a rectangle with cutout in accordance with embodiments of the present invention. This rectangle has longer side portions 131, 132, a connector portion 133, and shorter side portions 134, 135. A cut portion is formed between the shorter side portions 133 and 135. It is not always necessary that the shorter side portions 133 and 135 be identical in length. A high frequency filter is similarly constructed except that resonating portions of this shape are used.

Figure 34:
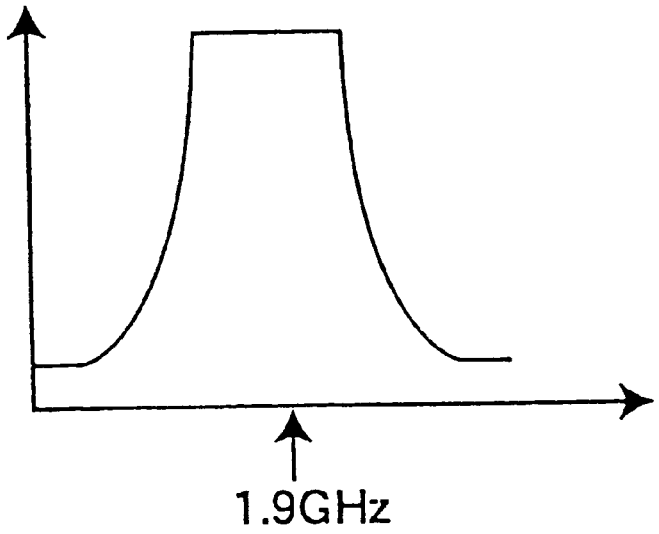
FIG. 34 is a frequency characteristic diagram of the high frequency filter in accordance with embodiments of the invention.

FIG. 34 shows the transmission characteristics of this high frequency filter. The center frequency was about 1.9 GHz and the bandwidth was about 20 MHZ, the obtained characteristics were ripple of about 0.3 dB and insertion loss of about 0.4 dB. Also, excellent skirt characteristics of about 30 dB/1 MHZ were obtained. In such resonators, resonance and so on produced in the straight portions are different from the wavelength of pass frequency band and so desired filter characteristics can be realized without disturbing ripple in the passband. Also, resonators can be formed in any arbitrary direction on the R-plane.

Figure 35:
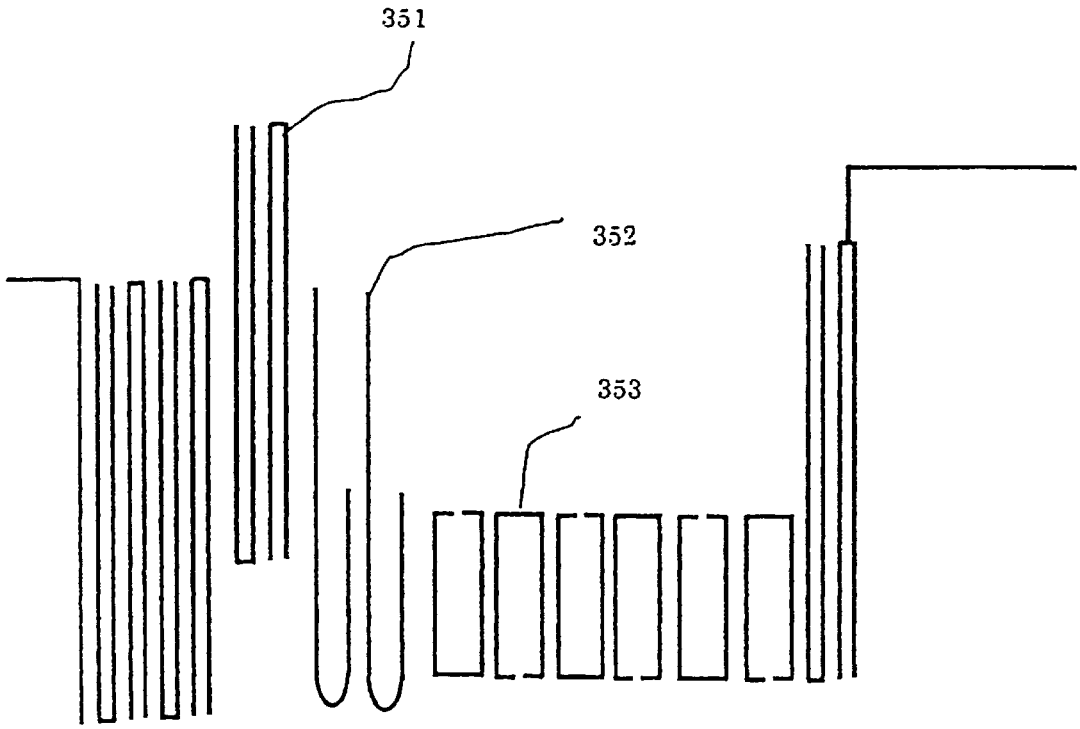
FIG. 35 is a layout diagram of a high frequency filter in accordance with embodiments of the invention.

FIG. 35 shows a layout diagram of a high frequency filter in accordance with embodiments of the present invention. A grounding conductor (not shown) is formed on one face of a substrate (not shown) having a thickness of about 0.43 mm. The substrate has a cut and exposed sapphire R-plane. A strip conductor shown in FIG. 35 is formed on the other face. A Y-based superconductive thin film having a thickness of about 500 nm is used in this strip conductor. The linewidth of the strip conductor is about 0.4 mm.

In embodiments of the present invention, a high frequency filter comprises hairpin type resonating portions 351 having corners, J-type resonating portions 352, and rectangular resonating portions 353 with cutout. These are arranged asymmetrically. The angle $\psi$ made between each longer side of the resonating portions 351 and the <11-20> direction on the sapphire substrate is 0°, in the same way as in the fourth embodiment.

Figure 36:
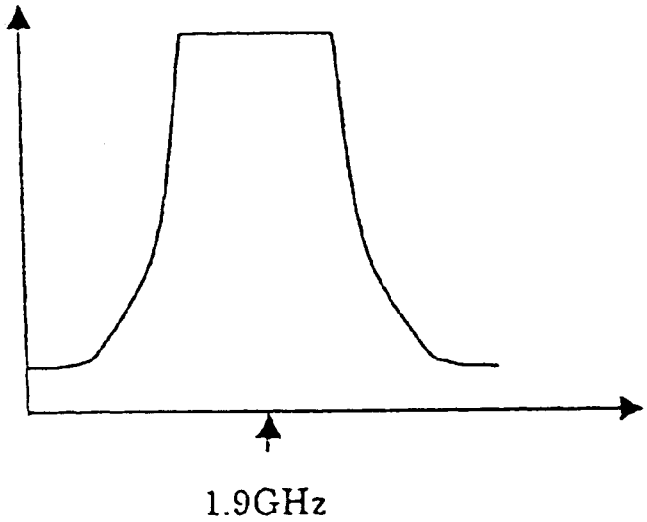
FIG. 36 is a frequency characteristic diagram of the high frequency filter in accordance with embodiments of the invention.

The transmission characteristics of this filter circuit are shown in FIG. 36. The center frequency was about 1.9 GHz and the bandwidth was about 20 MHZ, the obtained characteristics were ripple of about 0.4 dB and insertion loss of about 0.5 dB. Also, excellent skirt characteristics of about 30 dB/1 MHZ were obtained.

In this way, even the filter including an asymmetrical arrangement of both hairpin type resonating portions and resonating portions of other shapes can accomplish desired filter characteristics without disturbing the ripple in the passband by controlling the angle made between each longer side of the hairpin type resonating portions and the <11-20> direction of the sapphire substrate.

The embodiments of the present invention can realize low-cost bandpass filters having steep skirt characteristics, even if symmetrical resonating portions are placed on a sapphire R-plane, by controlling their direction.

Also, asymmetrical arrangement of resonating portions can accomplish low-cost bandpass filters having steep skirt characteristics by the use of a sapphire R-plane substrate.

What is claimed is:

1. A high frequency filter comprising:

a substrate having a first face and a second face, wherein said first face is a sapphire R-plane;

a conductive layer provided on said second face of said substrate and connected a fixed electrical potential level;

an input terminal and an output terminal formed on said first face of said substrate; and a plurality of resonating portions formed between said input terminal and said output terminal, wherein said resonating portions each have a hairpin-shape, said hairpin shape having at least one long side and at least one short side, said at least one long side arranged to make an angle of $\psi$ with <11-20> direction of said first face, wherein $0° \leqq \psi \leqq 30°$.

2. A high frequency filter according to claim 1, wherein said at least one short side is rounded.

3. A high frequency filter according to claim 1, wherein said at least one short side is straight and makes a right angle with said at least one long side.

4. A high frequency filter according to claim 1, wherein said conductive layer, said resonating portions, said pair of input terminals and said output terminal are made of a superconductive material.

5. A high frequency filter according to claim 4, further comprising a buffer layer between said first face and said superconductive material.

6. A high frequency filter according to claim 5, wherein said buffer layer a material selected from a group of $CeO_2$ and YSZ.

7. A high frequency filter according to claim 4, wherein said superconductive material consists of an Y-based superconductor.

8. A high frequency filter according to claim 1, wherein said resonating portions have a surface resistance of $10^{-2}$ Ohms or less.

9. A high frequency filter according to claim 1, wherein said resonating portions have a surface resistance of $10^{-4}$ Ohms or less.

10. A high frequency filter according to claim 1, wherein said input terminal and said output terminal use gap excitation.

11. A high frequency filter according to claim 1, wherein said input terminal and said output terminal use tap excitation.

12. A high frequency filter according to claim 1, wherein:

said high frequency filter is configured to pass a wavelength range; and said long sides have a length that is half of a wavelength that is within said wavelength range.

13. A high frequency filter according to claim 1, wherein said wavelength range has a center frequency of 1.9 GHz.

14. A high frequency filter according to claim 1, configured to have a skirt characteristics of 30 dB/MHz.

15. A high frequency filter according to claim 1, wherein:

each of said plurality of resonating portions are spatially separated; and each of said at least one long side are parallel along the entire length.

16. A high frequency filter according to claim 1, wherein:

each of said plurality of resonating portions are spatially separated; and said at least one long side of every alternating resonating portion are parallel along the entire length.

17. A high frequency filter according to claim 1, wherein $\psi$ equals 0°.

18. A high frequency filter according to claim 1, wherein $\psi$ equals 10°.

19. A high frequency filter according to claim 1, wherein each of said plurality of resonating portions has a rectangular shape with an opening.

20. A high frequency filter according to claim 1, each of said plurality of resonating portions has a J-shape.

21. A high frequency filter, comprising:

a substrate having a first face and a second face, said first face being a sapphire R-plane;

a conductive layer disposed on said second face of said substrate and connected a fixed electrical potential level;

an input terminal and an output terminal formed on said first face of said substrate; resonating portions formed between said input terminal and said output terminal, said resonating portion each having a long side and an asymmetric shape, wherein one of said long side is arranged to make an angle of $\psi$ with <11-20> direction of said first face and $0° \leqq \psi \leqq 30°$.

22. A high frequency filter according to claim 21, wherein said resonating portions have substantially the same shape.

23. A high frequency filter according to claim 22, wherein:

said resonating portions are spatially separated between said input terminal and said output terminal; and each of said resonating portions are parallel along the entire length.

24. A method comprising:

forming a substrate having a first face and a second face, wherein said first face a sapphire R-plane;

forming a conductive layer on said second face, wherein said conductive layer is configured to be connected to a fixed electrical potential level;

forming a pair of input terminals and an output terminal on said first face; and forming resonating portions between said input terminal and said output terminal, herein said resonating portions each have a hairpin-shape, said hairpin shape having at least one long side and at least one short side, said at least one long side is arranged to make an angle of $\psi$ with <11-20> direction of said first face, wherein $0° \leqq \psi \leqq 30°$.

* * * * *